US006945214B2

(12) United States Patent
Sachdev et al.

(10) Patent No.: US 6,945,214 B2
(45) Date of Patent: Sep. 20, 2005

(54) SIMPLIFIED ENGINE ARCHITECTURE AND ASSEMBLY

(75) Inventors: Anil K. Sachdev, Rochester Hills, MI (US); Brian D. Kaminski, Lake Orion, MI (US); Alexander Millerman, Bloomfield Hills, MI (US); Gary L. Jones, Farmington Hills, MI (US); William H. Haverdink, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/739,435

(22) Filed: Dec. 18, 2003

(65) Prior Publication Data

US 2005/0132996 A1 Jun. 23, 2005

(51) Int. Cl.[7] ..... F02F 7/00
(52) U.S. Cl. ..... 123/195 R

(58) Field of Search ..... 123/195 R, 197.4, 123/195 C, 195 S, 195 H

(56) References Cited

U.S. PATENT DOCUMENTS 4,245,595 A * 1/1981 Abe et al. ..... 123/195 C
5,404,847 A * 4/1995 Han ..... 123/195 R
5,564,837 A * 10/1996 Putnam et al. ..... 384/434
6,543,405 B2 4/2003 Sachdev et al.

* cited by examiner

*Primary Examiner*—Henry C. Yuen
*Assistant Examiner*—Hyder Ali
(74) *Attorney, Agent, or Firm*—Kathryn A. Marra

(57) ABSTRACT

A modular engine assembly includes a cylinder bore block, a cylinder head disposed above the cylinder bore block, and a crankcase assembly disposed below the cylinder bore block. The crankcase assembly includes an upper carrier and a lower carrier each having a plurality of bearing portions therein being integral, unitary, and one-piece.

22 Claims, 2 Drawing Sheets

SIMPLIFIED ENGINE ARCHITECTURE AND ASSEMBLY

TECHNICAL FIELD

The present invention relates generally to engines and, more particularly, to a simplified modular engine assembly for an internal combustion engine.

BACKGROUND OF THE INVENTION

It is known to provide an engine such as an internal combustion engine for a vehicle such as a motor vehicle. The modern two and four cycle internal combustion engines are an elegant and increasingly fuel-efficient machine. Because of the wide ranging needs of vehicle owners, engines of widely different torque and power outputs must be produced. But each different engine size (or displacement) is of complicated construction and requires a large investment to design and manufacture.

In simplest terms, these internal combustion engines typically include a plurality of pistons reciprocating within cylindrical bores and connected to a crankshaft with connecting rods. The crankshaft is supported in the engine block by individual bearing caps. During a combustion pressure induced power stroke, each piston applies torque to the crankshaft to provide the motive power of the engine. The torque and power delivered through the crankshaft is a function of the pressure surface area of the pistons and the length of their power strokes.

This assembly of pistons, connecting rods, crankshaft, and bearing caps is housed in an engine block. The engine block defines the cylinders in which the pistons reciprocate and it locates and supports the crankshaft, connecting rods, and bearing caps or bearing support surfaces. It is open at the bottom. The pistons, connecting rods, crankshaft, and bearing caps or bearing support surfaces are assembled from the bottom of the block after inverting it. Finally the bottom of the block is closed with an oil pan. The engine block also contains engine coolant and lubricating oil passages. A cylinder head closes the tops of the cylinders in the block to define therein each respective combustion chamber with the enclosed piston head. The cylinder head also contains one or more air or fuel/air inlet ports and valves, one or more exhaust gas ports and valves, a spark plug and, often, a fuel injector. It also contains coolant and oil passages. Both the engine block and the cylinder head are metal castings of complex design because of integrated features such as coolant and oil passages. Each casting must be designed for the specified displacement of the engine.

As observed, it is very expensive to manufacture such engines with specifically designed and cast engine blocks and cylinder heads. The complex casting requires a high capital investment manufacturing facility for both casting and machining. As a result, making changes to the design of the engine block are, therefore, difficult to implement.

Further, the bearing caps or bearing support surfaces are made separately and machined to close tolerances. The bearing caps or bearing support surfaces are pre-assembled in the crankcase to enable machining such as by flush grinding of the final bearing surfaces, and then disassembled for inserting the crankshaft and for final crankshaft assembly.

Therefore, it is desirable to realize a large savings in the manufacture of automobile engines if the design and manufacture of the engine block could be simplified. It is also desired to provide a modular approach to making the engine structural components that contain the pistons, connecting rods, crankshaft, and bearing caps or bearing support surfaces. It is further desirable to separate the cylinder block portion of engine construction from the crankcase containing and assembling portion of the engine. Therefore, there is a need in the art to provide a simplified modular engine assembly that meets these desires.

SUMMARY OF THE INVENTION

It is, therefore, one object of the present invention to provide a new modular engine assembly that is simplified to include bearing caps or bearing support surfaces.

To achieve the foregoing objects, the present invention is a modular engine assembly including a cylinder bore block, a cylinder head disposed above the cylinder bore block, and a crankcase assembly disposed below the cylinder bore block. The crankcase assembly includes an upper bearing carrier and a lower bearing carrier each having a plurality of bearing caps or bearing support surfaces therein being integral, unitary, and one-piece.

One advantage of the present invention is that a modular engine assembly is provided for an internal combustion engine. Another advantage of the present invention is that the modular engine assembly has bearing caps or bearing support surfaces cast into a separate upper casting and lower casting or a shape made from a molding or extrusion or a machined object that forms a clamshell. Yet another advantage of the present invention is that the modular engine assembly eliminates the need for separate bearing caps or bearing support surfaces, which added some complexity to the manufacturing process. Still another advantage of the present invention is that the modular engine assembly eliminates a midplate, one sealing surface, and cross bolts for locking the bearing caps or bearing support surfaces. A further advantage of the present invention is that the modular engine assembly has simpler fixturing and manufacturing of the engine block. Yet a further advantage of the present invention is that the modular engine assembly has faster manufacturing throughput since bearing caps or bearing support surfaces do not have to be pre-machined, assembled, machined, and then disassembled for the crankshaft assembly. Still a further advantage of the present invention is that the modular engine assembly has faster engine build since bearing caps or bearing support surfaces do not have to be assembled individually. Another advantage of the present invention is that the modular engine assembly has better dimensional control due to fewer parts. Yet another advantage of the present invention is that the modular engine assembly provides a stiffer engine due to fewer interfaces. Still another advantage of the present invention is the absence of a separate oil pan that can now be integrated into a lower carrier and increases engine structure stiffness.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
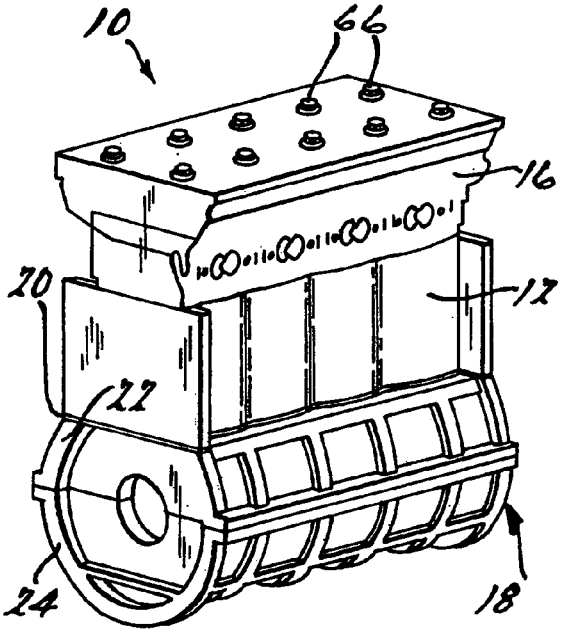
FIG. 1 is a perspective view of a modular engine assembly, according to the present invention.
Figure 2:
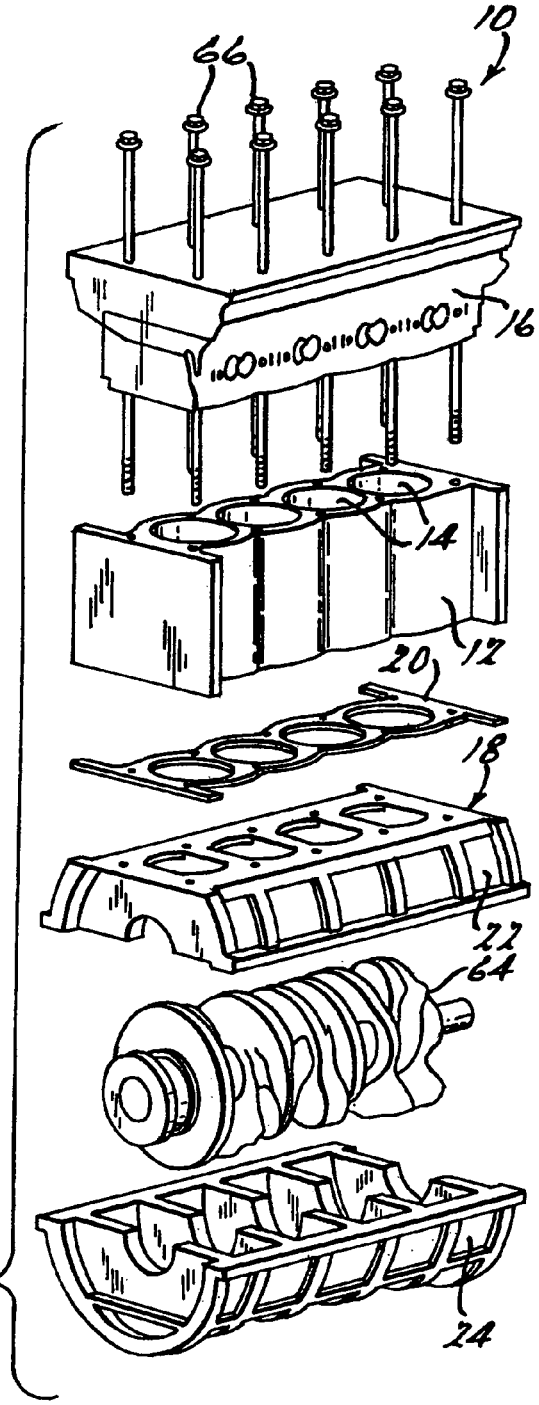
FIG. 2 is an exploded perspective view of the modular engine assembly of FIG. 1.
Figure 3:
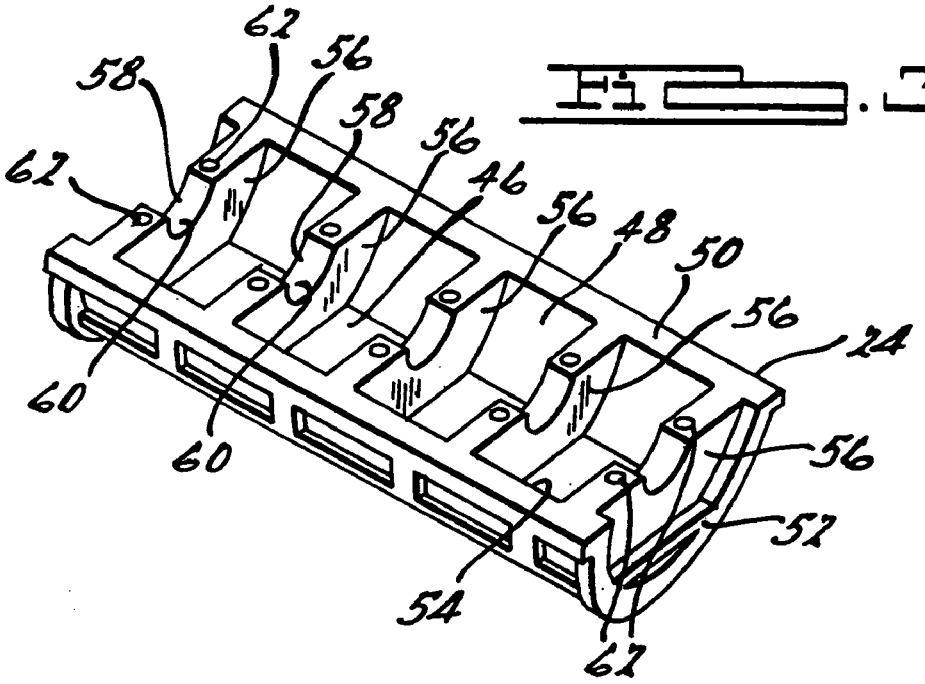
FIG. 3 is a perspective view of a lower carrier of the modular engine assembly of FIG. 1.
Figure 4:
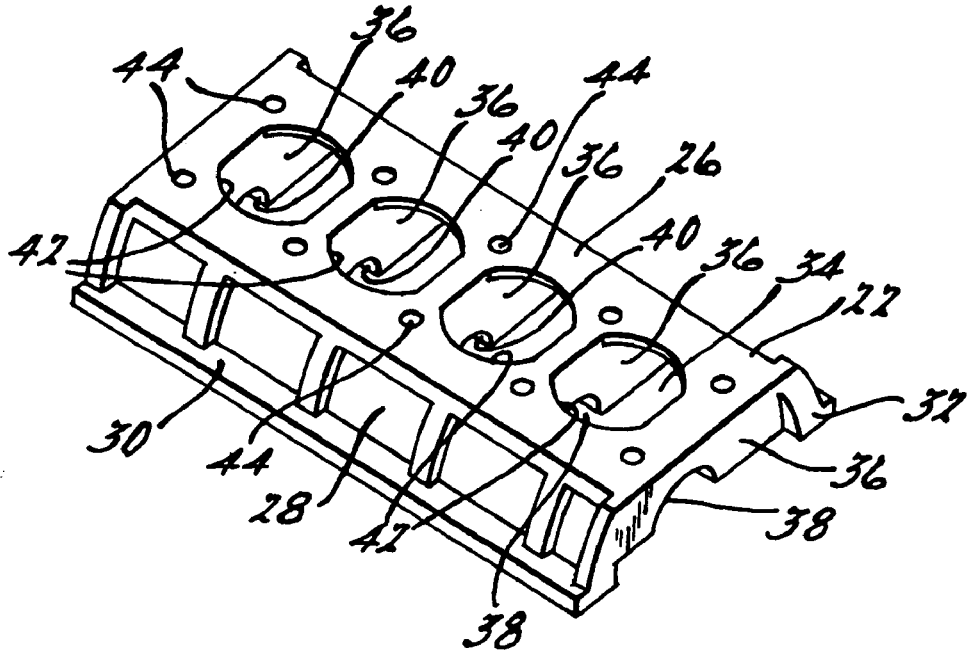
FIG. 4 is a perspective view of an upper carrier of the modular engine assembly of FIG. 1.

Referring to the drawings and in particular FIG. 1, one embodiment of a modular engine assembly 10, according to the present invention, is shown for a vehicle (not shown). The modular engine assembly 10 is of an internal combustion type. The modular engine assembly 10 includes an extruded cylinder bore block 12 having at least one, preferably a plurality of cylindrical bores 14 spaced longitudinally therealong. The cylinder bore block 12 is a shape that can be made from a casting, molding, shaping, or extrusion from a variety of materials such as cast iron, aluminum, magnesium, or those materials with surface treatment. The cylinder bore block 12 is of a type disclosed in U.S. Pat. No. 6,543,405, the disclosure of which is hereby incorporated by reference.

The modular engine assembly 10 also includes a cylinder head 16 disposed above the cylinder bore block 12. The cylinder head 16 closes a top of the cylinder bores 14 to provide a combustion chamber in each bore 14 in cooperation with a respective piston (not shown) reciprocating in the bore 14. The cylinder head 16 contains inlet and exhaust ports (not shown), and positions and supports intake and exhaust valves (not shown). The cylinder head 16 also contains a spark plug (not shown), in the case of a spark ignition engine, and it often contains a fuel injector (not shown). It should be appreciated that the components of the cylinder head 16 are not illustrated, for purposes of simplicity of disclosure, because their design, construction and operation does not necessarily have to be altered by the use of the modular engine components of the present invention.

The modular engine assembly 10 further includes a crankcase assembly, generally indicated at 18, disposed below the cylinder bore block 12. The cylinder bore block 12 and crankcase assembly 18 are separated by a gasket 20. It should be appreciated that the modular engine assembly 10 has a simplified modular architecture in that two 3-cylinder modules may be joined to provide an in-line 6-cylinder engine and possibly a V-6 engine.

Referring to FIGS. 1 through 4, the crankcase assembly 18 includes an upper carrier 22 and a lower carrier 24. The upper carrier 22 is a shape that can be made from a casting, molding, shaping, or extrusion from a variety of materials such as cast iron, aluminum, magnesium, or those materials with surface treatment. The upper carrier 22 has an upper base wall 26 extending longitudinally and opposed side walls 28 extending downwardly and outwardly from the base wall 26. The upper carrier 22 has a flange 30 extending outwardly from each of the side walls 28. The upper carrier 22 has an end wall 32 at each longitudinal end thereof. The upper carrier 22 has a cavity 34 therein formed by the base wall 26, side walls 28, and end walls 32. The upper carrier 22 has a plurality of bearing portions 36 disposed within and spaced longitudinally within the cavity 34. The bearing portions 36 extend from the base wall 26 and side walls 28 into the cavity 34. Each of the bearing portions 36 has a centrally located and generally arcuate recess 38 extending therein forming a support surface 40. The upper carrier 22 has a plurality of cylinder bore apertures 42 extending through the upper base wall 26 and aligned with the cylinder bores 14 of the cylinder bore block 12. The upper carrier 22 also has a plurality of fastener apertures 44 spaced from the cylinder bore apertures 42 to receive fasteners 66 to be described. The upper carrier 22 is a monolithic structure being integral, unitary, and one-piece.

The lower carrier 24 is a shape that can be made from a casting, molding, shaping, or extrusion from a variety of materials such as cast iron, aluminum, magnesium, or those materials with surface treatment. The lower carrier 24 has a lower base wall 46 extending longitudinally and opposed side walls 48 extending upwardly and outwardly from the base wall 46. The lower carrier 24 has a flange 50 extending outwardly from each of the side walls 48. The lower carrier 24 has an end wall 52 at each longitudinal end thereof. The lower carrier 24 has a cavity 54 therein formed by the base wall 46, side walls 48, and end walls 52. The lower carrier 24 has a plurality of bearing portions 56 disposed within and spaced longitudinally within the cavity 54. The bearing portions 56 extend from the base wall 46 and side walls 48 into the cavity 54. Each of the bearing portions 56 has a centrally located and generally arcuate recess 58 forming a support surface 60. The lower carrier 24 also has a plurality of fastener apertures 62 to receive fasteners 66 to be described. The lower carrier 24 is a monolithic structure being integral, unitary, and one-piece. It should be appreciated that the bearing portions 36 and 56 are identical to form a complete bearing cap or bearing support surface for a crankshaft assembly 64 to be described.

The crankcase assembly 18 also includes a crankshaft assembly 64 disposed between the upper carrier 22 and the lower carrier 24. The upper carrier 22 and the lower carrier 24 form a clamshell and the bearing portions 36, 56 support the crankshaft assembly 64 therein. The crankcase assembly 18 further includes a plurality of fasteners 66 such as bolts extending through apertures (not shown) in the cylinder head 16, cylinder bore block 12, and gasket 20, and through the fastener apertures 44 in the upper carrier 22 and threadably engaging the fastener apertures 62 in the lower carrier 24. It should be appreciated that the fasteners 66 secure the upper carrier 22 and lower carrier 24 together. It should also be appreciated that the cylinder bore block 12, cylinder head 14, and crankcase assembly 18 are structural parts of the modular engine assembly 10.

During manufacturing, the upper carrier 22 and lower carrier 24 are faced off and held together. The support surfaces 40, 60 are machined with one boring pass. The upper carrier 22 and lower carrier 24 are separated and the crankshaft assembly 64 is assembled within the upper carrier 22 and lower carrier 24. The upper carrier 22 and lower carrier 24 are held together and the fasteners 66 secure the upper carrier 22 and lower carrier 24 together. It should be appreciated that, when the modular engine assembly 10 is in an assembled condition, the cylinder bore block 12, cylinder head 16, and crankcase assembly 18 cooperate to enclose the crankshaft 64 in the crankcase assembly 18, four pistons (not shown) in cylinder bores 14, and four connecting rods (not shown) extending from the cylinder bores 14 into crankcase assembly 18.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A modular engine assembly comprising:

a cylinder bore block;

a cylinder head disposed above said cylinder bore block;

a crankcase assembly disposed below said cylinder bore block, wherein said crankcase assembly comprises an upper carrier and a lower carrier each having a plurality of bearing portions therein being integral, unitary, and one-piece;

said upper carrier and said lower carrier each having a plurality of fastener apertures extending through said bearing portions; and a plurality of fasteners extending through said fastener apertures to secure said upper carrier and said lower carrier together.

2. A modular engine assembly as set forth in claim 1 wherein said cylinder bore block is a shape that can be made from one of a casting, molding, shaping, and extrusion from one of a group of materials comprising cast iron, aluminum, magnesium, or those materials with surface treatment.

3. A modular engine assembly as set forth in claim 1 wherein said upper carrier is a shape that can be made from one of a casting, molding, shaping, or extrusion from one of a group of materials comprising cast iron, aluminum, magnesium, or those materials with surface treatment.

4. A modular engine assembly as set forth in claim 1 wherein said lower carrier is a shape that can be made from one of a casting, molding, shaping, or extrusion from one of a group of materials comprising cast iron, aluminum, magnesium, or those materials with surface treatment.

5. A modular engine assembly as set forth in claim 1 wherein each of said bearing portions has a recess forming a support surface.

6. A modular engine assembly as set forth in claim 1 wherein said upper carrier has a cavity therein and said bearing portions being disposed in said cavity and spaced longitudinally therealong.

7. A modular engine assembly as set forth in claim 1 wherein said lower carrier has a cavity therein and said bearing portions being disposed in said cavity and spaced longitudinally therealong.

8. A modular engine assembly as set forth in claim 1 wherein said upper carrier has a plurality of cylinder bore apertures extending therethrough.

9. A modular engine assembly as set forth in claim 1 including a crankshaft assembly disposed between said upper carrier and said lower carrier.

10. A modular engine assembly comprising:

a cylinder bore block;

a cylinder head disposed above said cylinder bore block;

a crankcase assembly disposed below said cylinder bore block, wherein said crankcase assembly comprises an upper carrier and a lower carrier;

said upper carrier and said lower carrier each having a plurality of bearing portions therein being integral, unitary, and one-piece;

said upper carrier having a plurality of first fastener apertures extending therethrough and said lower carrier having a plurality of second fastener apertures therein; and a plurality of fasteners extending through said cylinder head, said cylinder bore block, and said first fastener apertures and into said second fastener apertures to secure said cylinder head, said cylinder bore block, said upper carrier, and said lower carrier together.

11. A modular engine assembly as set forth in claim 10 wherein said cylinder bore block is a shape that can be made from one of a casting, molding, shaping, and extrusion from one of a group of materials comprising cast iron, aluminum, magnesium, or those materials with surface treatment.

12. A modular engine assembly as set forth in claim 10 wherein said upper carrier is a shape that can be made from one of a casting, molding, shaping, or extrusion from one of a group of materials comprising cast iron, aluminum, magnesium, or those materials with surface treatment.

13. A modular engine assembly as set forth in claim 10 wherein said lower carrier is a shape that can be made from one of a casting, molding, shaping, or extrusion from one of a group of materials comprising cast iron, aluminum, magnesium, or those materials with surface treatment.

14. A modular engine assembly as set forth in claim 10 wherein each of said bearing portions has a recess forming a support surface.

15. A modular engine assembly as set forth in claim 10 wherein said upper carrier has a cavity therein and said bearing portions being disposed in said cavity and spaced longitudinally therealong.

16. A modular engine assembly as set forth in claim 10 wherein said lower carrier has a cavity therein and said bearing portions being disposed in said cavity and spaced longitudinally therealong.

17. A modular engine assembly as set forth in claim 10 wherein said upper carrier has a plurality of cylinder bore apertures extending therethrough.

18. A modular engine assembly as set forth in claim 10 including a crankshaft assembly disposed between said upper carrier and said lower carrier.

19. A modular engine assembly comprising:

a cylinder bore block;

a cylinder head disposed above said cylinder bore block;

a crankcase assembly disposed below said cylinder bore block, wherein said crankcase assembly comprises an upper carrier and a lower carrier;

each of said upper carrier and said lower carrier having a plurality of bearing portions therein;

said bearing portions being integral, unitary, and one-piece with said upper carrier and said lower carrier, each of said bearing portions having a recess forming a support surface;

said upper carrier having a plurality of first fastener apertures extending therethrough and said lower carrier having a plurality of second fastener apertures therein;

a crankshaft assembly disposed between said upper carrier and said lower carrier; and a plurality of fasteners extending through said cylinder head, said cylinder bore block, and said first fastener apertures and into said second fastener apertures to secure said cylinder head, said cylinder bore block, said upper carrier, and said lower carrier together.

20. A modular engine assembly as set forth in claim 19 wherein said cylinder bore block is a shape that can be made from one of a casting, molding, shaping, and extrusion from one of a group of materials comprising cast iron, aluminum, magnesium, or those materials with surface treatment.

21. A modular engine assembly as set forth in claim 19 wherein said upper carrier is a shape that can be made from one of a casting, molding, shaping, or extrusion from one of a group of materials comprising cast iron, aluminum, magnesium, or those materials with surface treatment.

22. A modular engine assembly as set forth in claim 19 wherein said lower carrier is a shape that can be made from one of a casting, molding, shaping, or extrusion from one of a group of materials comprising cast iron, aluminum, magnesium, or those materials with surface treatment.

* * * * *